United States Patent [19]

Mahoney

[11] 4,215,446

[45] Aug. 5, 1980

[54] PADDED HOSPITAL BED SIDERAIL COVER

[76] Inventor: Patsie Mahoney, 1641 W. Territorial Rd., Battle Creek, Mich. 49015

[21] Appl. No.: 937,127

[22] Filed: Aug. 28, 1978

[51] Int. Cl.[2] ..... A47C 7/42

[52] U.S. Cl. ..... 5/425; 5/508; 248/345.1; 297/231

[58] Field of Search ..... 297/219, 225, 230, 231, 297/460, DIG. 1, DIG. 2; 5/337, 339, 331, 317, 100; 248/345

[56] References Cited

U.S. PATENT DOCUMENTS

| | | | |
|---|---|---|---|
| 3,266,545 | 8/1966 | Kruissink | 297/219 |
| 3,321,779 | 5/1967 | Kaufman et al. | 5/357 |
| 3,610,685 | 10/1971 | Lay | 297/231 |
| 3,695,690 | 10/1972 | Carson | 297/219 |
| 3,742,530 | 7/1973 | Clark | 5/331 |

*Primary Examiner*—Casmir A. Nunberg

*Attorney, Agent, or Firm*—Fisher, Gerhardt, Crampton & Groh

[57] ABSTRACT

A padded cover for a hospital bed siderail. Two panels of padded material of a shape similar to the appropriate bed rail and of a size sufficient to completely cover and enclose the bed rail are hinged together for movement between an open, spaced apart relationship and a closed, coplanar relationship enclosing the bed rail. Detachable fastening means are located along the lower edge of the panels for detachably fastening the two panels on the bed rail.

2 Claims, 3 Drawing Figures

PADDED HOSPITAL BED SIDERAIL COVER

This invention relates to a padded cover used to enclose the standard hospital bed siderail. The standard hospital bed rail has a hard metal upper frame and is not padded. It is therefore necessary to provide some kind of padding on the rail to prevent the injury of patients who may thrash about.

It is an object of the invention to provide a safety pad for a standard bed rail to prevent injury to patients.

Another object of the invention is to provide a bed rail pad which is specifically designed to closely fit standard sized hospital bed rails.

Still another object of the invention is to provide a bed rail pad which easily and quickly attaches and detaches from the bed rail.

A further object of the invention is to provide a bed rail pad which will fit over either end of the standard hospital bed rail.

The objects of the invention are accomplished by a pad which is made up of two panels of padded material of a shape similar to the standard hospital bed rail and of a size sufficient to enclose the entire upper frame of the rail. The panels are hinged together along the top pair of matching edges and one side pair of matching edges by a seamed piece of similar material. The open lower pair and other side pair of matching edges of the pads have strips of hooked and looped fabric sewn along their borders which allows the entire pad to be closed around the periphery of the bed rail's upper frame.

These and other objects of the invention will be apparent from the following description and from the drawings in which.

Figure 1:
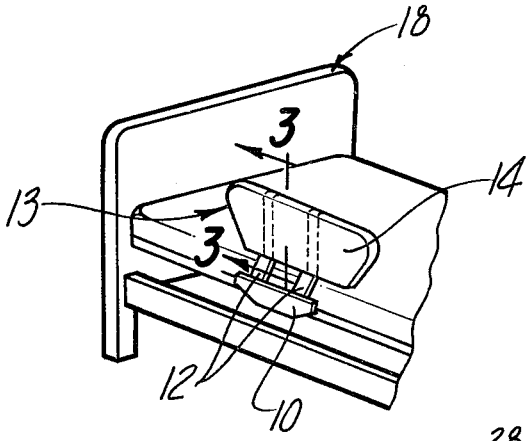
FIG. 1 is a perspective view of one end of a hospital bed with a standard bed rail attached.

A hospital bed designated generally at 8 includes a standard size side rail 10. Bed rail 10 has an upper frame 13. A padded cover 14 is shown in FIG. 1, attached to and enclosing the periphery of bed rail upper frame 13.

The standard bed rail 10 is made of metal. Two upstanding support members 12, seen in FIG. 1, are attached to bottom edge 20 and top edge 16 of the upper frame 13 of bed rail 10 and support said bottom and top edges, 20 and 16 respectively, in a parallel relationship. Two side edges 18, which are symmetrical and of equal length, are attached between top edge 16 and bottom edge 20 and complete the upper frame 13.

The pad 14 is composed generally of two panels 24 and 26. These panels are made of a padded material, that is, any material that is sufficiently resilient. Standard stitching is shown at 28. Each panel is shaped similar to the periphery of the upper frame 13 and of a slightly larger size. The panels 24 and 26 are stitched together with a strip of material 22 along their top matching edges and one side of pair of matching edges. The strip of material 22 is the same as the material making up the panels 24 and 26 and is approximately the width of the top edge 16 of the upper frame 13. The stitching creates a flexible hinge. Each panel 24 and 26 is slightly larger than the total area of the periphery of the upper frame 13, allowing the entire upper frame 13 to be enclosed by the two panels 24 and 26 when they are attached together. The cloth hinge 22 allows the two panels 24 and 26 to be moved between an open position with the panels 24 and 26 spaced apart, as seen in FIG. 2 and a closed position with the panels in opposed coplanar relationship as seen in FIG. 3.

Along the bottom pair of matching edges and remaining side pair of matching edges of the panels 24 and 26, matched strips of hooked and looped fabric, 30 and 32, are attached. These may be simply stitched or glued to the panels 24 and 26 along their outer borders. When the panels 24 and 26 are in the open position, looped fabric strip 30 is attached to the outside lower edge of panel 24 and hooked fabric strip 32 is attached to the inside lower edge of panel 26. This may of course be reversed. This allows the fabric strips 30 and 32 to fold in on each other when the pad is attached to the upper frame 13 as seen in FIG. 3. This hooked fabric is of the type generally marketed under the tradename "Velcro". Each panel 24 and 26 is additionally cut away along its lower edge as designated at 34, to allow the pad to be fitted around the twin support members 12.

Figure 2:
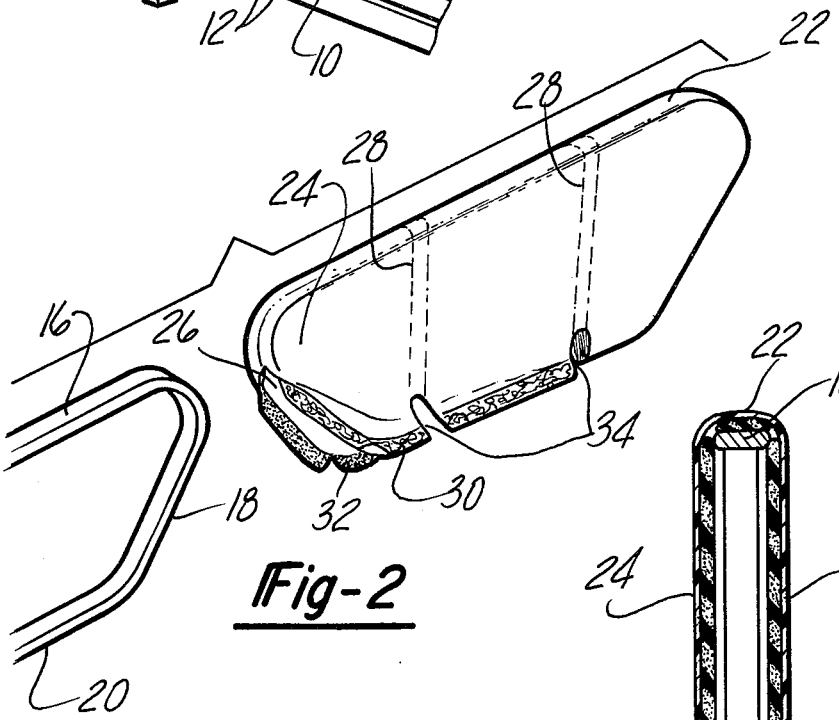
FIG. 2 is a perspective view of the upper frame of the bed rail with the padded cover shown removed and opened in the position it would be held prior to placement on the bed rail.
Figure 3:
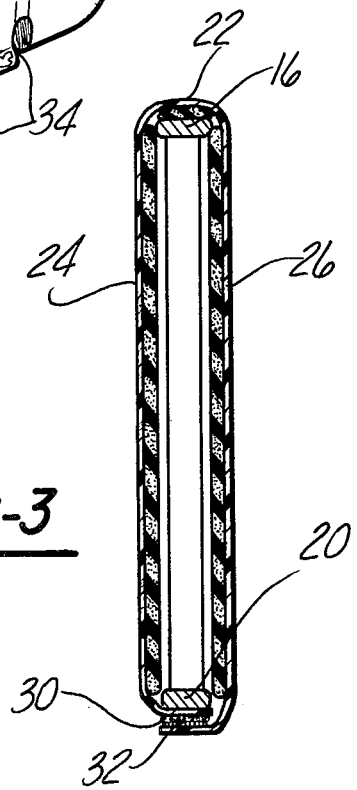
FIG. 3 is a cross sectional view taken along line 3—3 in FIG. 1 of the bed rail with the pad attached.

The pad 14 is attached to upper frame 13 by separating the panels 24 and 26 as shown in FIG. 2, then slipping the entire pad over the frame. The strips of fabric 30 and 32 are then folded in on each other as seen in FIG. 3 for a snug fit around the frame. These strips of fabric 30 and 32 are simply stripped apart to remove the pad.

A removable padded cover for a standard hospital bed siderail has been provided, which may be easily attached and detached. Substantially the entire metal upper frame is protected and padded. A snug, tight fit is provided, which may still be easily removed by a nurse, and easily cleaned. The pad fits easily over either end of the standard siderail.

The embodiments of the invention in which an exclusive property or privilege is claimed are defined as follows:

1. A removable padded cover for a hospital bed rail of the type having a symmetrical upper frame with substantially parallel top and bottom edges, and opposed side edges, comprising two substantially equal sized panels of padded material, each panel being substantially identical in shape to the periphery of said upper frame and having a slightly larger area than said upper frame, a flexible seam joining said panels together along the top pair and one adjacent side pair of matching peripheral edges of said panels, and detachable fastening means located along the outer borders of the bottom and remaining side matching pair of peripheral edges of said panels, for fastening said panels together and enclosing and covering substantially the entire upper frame when said pair of hinged panels is fitted over either end of said upper frame.

2. A removable padded cover for a hospital bed as described in claim 1, wherein said detachable fastening means comprises a strip of hooked fabric and a strip of looped fabric, one of said fabric strips being located on the inside lower exterior edge of one of said panels, and the other strip of fabric being located on the outer lower exterior edge of the other of said panels such that the strip of fabric on the inside lower exterior edge of one panel may be folded over on to the strip of fabric located on the outside lower exterior edge of the other panel, said panels enclosing and covering substantially the entire upper frame when said pair of hinged panels is fitted over either end of the upper frame.

* * * * *